United States Patent [19]

Stigsson

[11] Patent Number: 4,580,723

[45] Date of Patent: Apr. 8, 1986

[54] METHOD FOR ATOMIZING DISPERSIONS OR SOLUTIONS CONTAINING PARTICLES

[75] Inventor: Lars L. Stigsson, Lund, Sweden

[73] Assignee: Fluidcarbon International AB, Malmö , Sweden

[21] Appl. No.: 519,766

[22] PCT Filed: Mar. 31, 1982

[86] PCT No.: PCT/SE82/00098

§ 371 Date: Jul. 13, 1983

§ 102(e) Date: Jul. 13, 1983

[87] PCT Pub. No.: WO83/01749

PCT Pub. Date: May 26, 1983

[30] Foreign Application Priority Data

Nov. 13, 1981 [SE] Sweden ..... 8106752

[51] Int. Cl.[4] ..... B05B 17/06

[52] U.S. Cl. ..... 239/4; 239/7; 239/8; 239/102; 239/104; 239/214.25; 239/290

[58] Field of Search ..... 239/4, 7, 8, 102, 104, 239/106, 214.25, 290, 400, 404–406, 419.3, 419.5, 422, 424

[56] References Cited

U.S. PATENT DOCUMENTS

| | | | |
|---|---|---|---|
| 1,342,732 | 6/1920 | Anthony | 239/405 |
| 1,680,455 | 8/1928 | Fesler et al. | 239/7 |
| 1,693,053 | 11/1928 | Rodler | 239/7 |
| 1,914,390 | 6/1933 | Whaley | 239/214.25 |
| 1,968,126 | 7/1934 | Center | 239/405 |
| 2,682,302 | 6/1954 | Cote | 239/406 |
| 3,784,104 | 1/1974 | Hartung | 239/102 |
| 3,896,998 | 7/1975 | Vertue | 239/106 |
| 3,908,904 | 9/1975 | Kerner | 239/4 |

FOREIGN PATENT DOCUMENTS

| | | | |
|---|---|---|---|
| 731189 | 4/1980 | U.S.S.R. | 239/102 |

*Primary Examiner*—Andres Kashnikow
*Assistant Examiner*—Michael J. Forman
*Attorney, Agent, or Firm*—Nils H. Ljungman

[57] ABSTRACT

A method for atomizing dispersions or solutions containing particles wherein the dispersion or solution is discharged from a nozzle. Before it leaves the nozzle it is brought to form a rotating annular film which is exposed to the influence of high-frequency sound for the disintegration of the liquid.

5 Claims, 2 Drawing Figures

METHOD FOR ATOMIZING DISPERSIONS OR SOLUTIONS CONTAINING PARTICLES

The present invention relates to a method for atomizing dispersions or solutions containing particles wherein the dispersion or solution is discharged from a nozzle.

It is previously known to utilize an acoustic effect e.g. ultrasound in order to atomize and scatter oils and suspensions with low particle contents and to affect mass and heat transport in the atomized or scattered suspension or solution, the so-called spray. When prior art technique is applied the vicosity of the dispersion or solution as well as the particle content thereof must be limited in order to avoid erosion and clogging in the conduits for supplying the dispersion or solution. The particular distribution in the spray moreover will not be homogenous, which results in an unsatisfactory mass and heat transport in the reaction zone, and the reason thereof among other things is that particles which are not separated in the suspension by the particles being charged or by applying other prior art technique, tend to form agglomerates at the atomization proper. When dispersions or solutions having a high particle content are being atomized other technique has been resorted to and one has utilized e.g. pressurized air nozzles and rotary nozzles but the experience from long-term tests with such nozzles is limited; there are however indications of dramatical erosion attacks already after short-term operation.

There is a need of providing equipment which can be used for atomizing dispersions having a high dry content, and the purpose of the invention is primarily to provide a method of the kind referred to above, by which a homogeneous fine-particulate drop size distribution in atomizing suspensions or solutions containing particles can be obtained in order thus to provide a specific surface as great as possible for chemical reactions such as combustion or for strictly physical processes such as evaporation of water in spray dryers. The rate of these processes is often governed by the molecular gas diffusion around the individual particles. E.g. when coal powder is being burnt, the transport of the oxygen to the coal particle through the vaporization and reaction products emitted from the oxidation of the coal particle is of great importance for the reaction rate.

The purpose mentioned above is achieved according to the invention by the method having obtained the characteristics appearing from claim 1.

The acoustic effect influences positively the molecular diffusion in drying processes and facilitates the oxygen transport to the fuel in oxidation processes.

As a consequence thereof there is obtained a particularly favourable influence on the drop sizes of the developed spray at a lower dependence of the viscosity and density of the atomized fluid. Moreover, there is obtained a positive influence on the molecular diffusion in drying processes, and oxygen transport e.g. to a coal fuel in oxidation processes is facilitated.

Figure 1A:
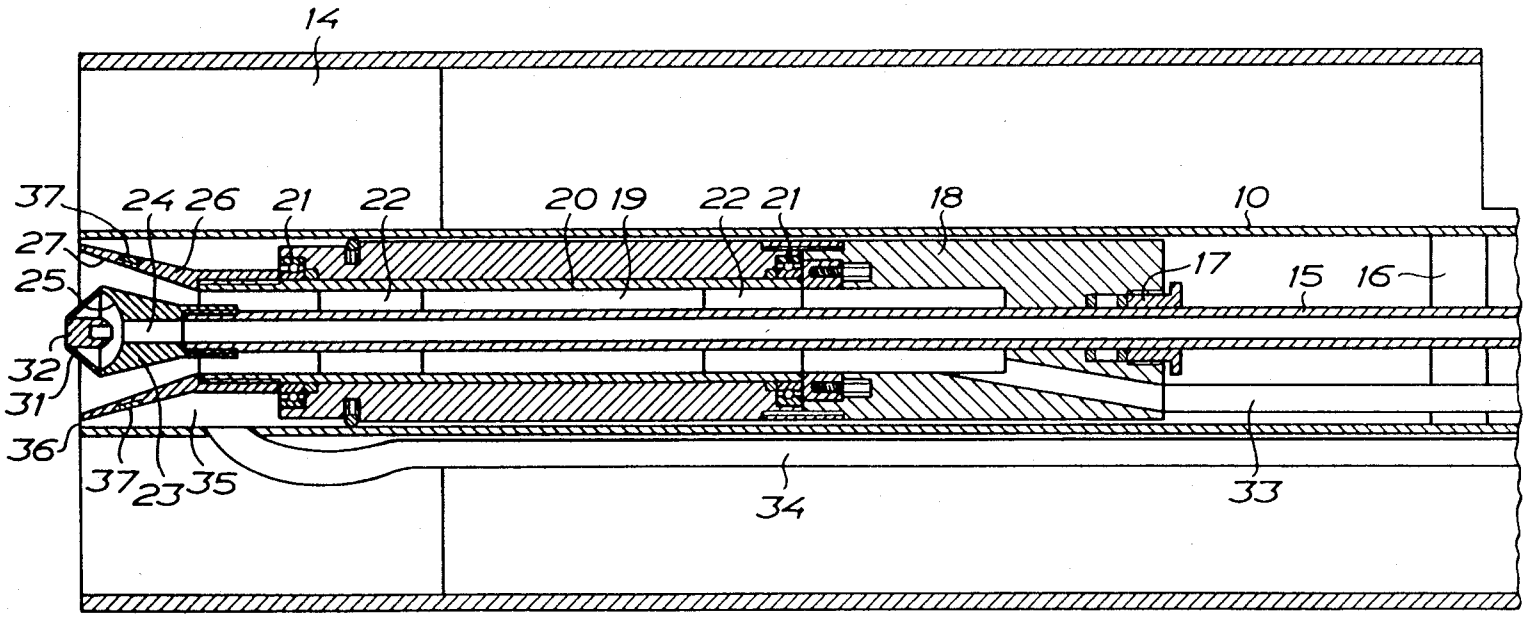
Figure 1B:
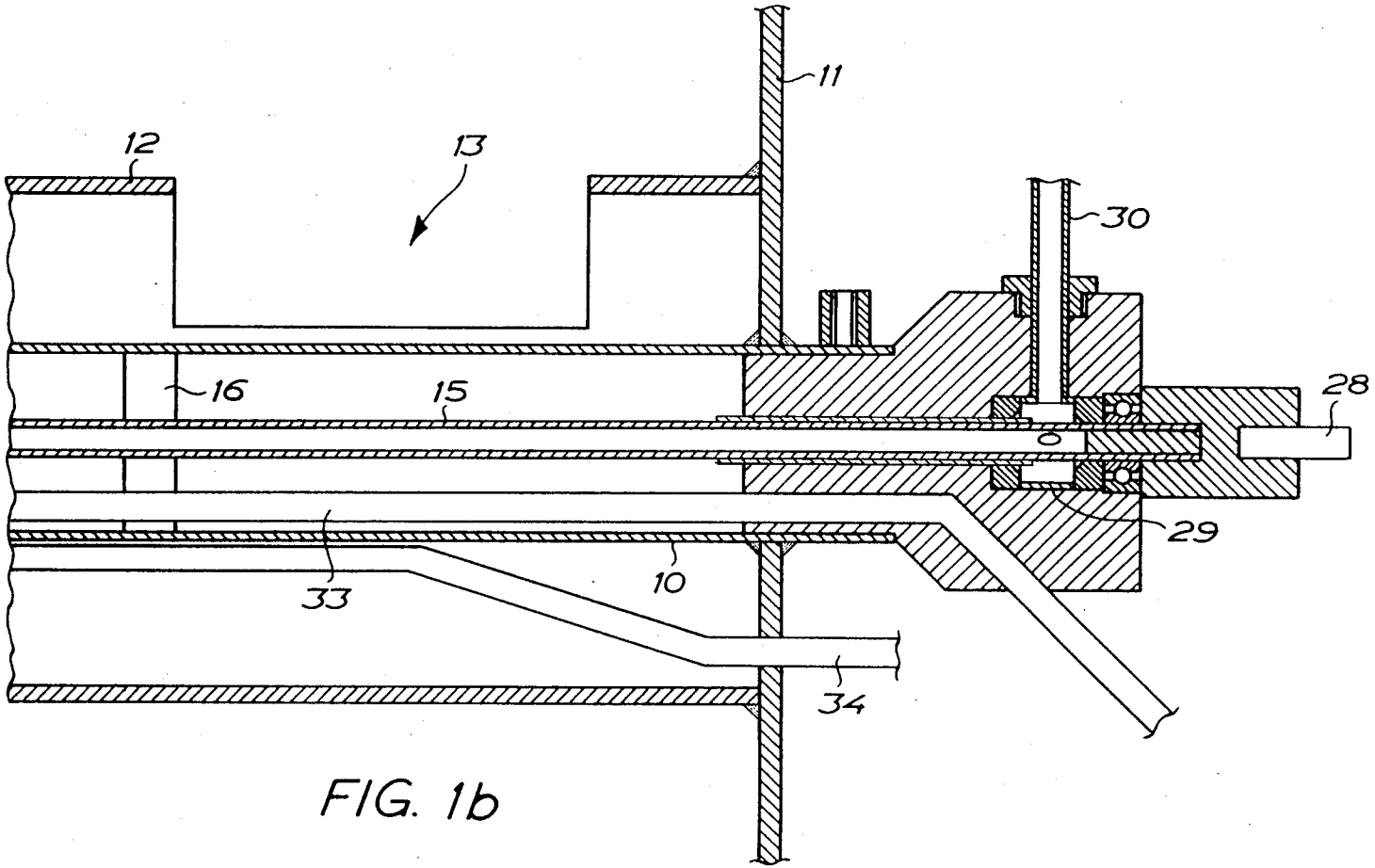

In order to explain the invention in more detail reference is made to the accompanying drawings in which FIG. 1*a* and FIG. 1*b* together is an axial sectional view of a burner for a coal water dispersion.

Referring to FIG. 1, the burner disclosed therein comprises a fixedly arranged tube 10 which is mounted in a front plate 11 by means of which the burner can be mounted in a combustion compartment, and is surrounded by a tubular casing 12 which is also mounted in the front plate and has an inlet aperture 13. The tubular casing 12 is connected with the tube 10 by means of vanes 14 which can be angled in relation to the axial direction in order to form a turbulator. In the tube 10 arranged coaxially therewith, a tube 15 is rotatably mounted by means of bearings 16, and this tube extends through a box 17 at the bottom of a socket 18 mounted in the tube 10, which surrounds the tube 15 spaced therefrom such that an annular passage 19 is provided between said tube and the socket. A tube 20 arranged as a lining in the socket 18 is rotatably mounted in the socket by means of bearings 21 and is connected by webs 22 to the tube 15 so as to be rotatable with said tube.

The tube 15 terminates at the left hand end thereof in a body 23 having a conical outside surface, which forms a central passage 24 communicating with the tube 15 and opening centrally in a concave end surface 25. The tube 20 terminates in a conical flange 26 with a conical inside surface 27, the end of said flange being substantially flush with the end of the tube 10.

At the right hand closed end of the tube 15 said tube is connected to a drive motor, not shown, at a drive pin 28 for the rotation of the tube 15 and thus of the tube 20, and also the body 23 and the flange 26, respectively, rotate together with these tubes. Adjacent the right hand end of the tube 15, a rotary coupling 29 is provided for the connection of a conduit 30 to the tube 15 so that a gaseous fluid can be supplied to the tube 15 from the outside and can be passed through this tube through the burner to the opening thereof. The body 23 located at the opening of the burner supports by means of arms 31 a cavity resonator 32 such as a Hartmann generator, the cavity of the resonator being located opposite to the opening of the passage 24 communicating with the tube 15. For an explanation in more detail of the arrangement and operation of the cavity resonator reference is made to the Swiss patent specification No. 484,359, FIG. 4, and the associated description.

A conduit 33 is passed from the outside into the tube 10 and extends through the bottom of the socket 18 in order to open into the annular passage 19. Another tube 34 is passed from the outside into the tubular casing 12 and extends along the outside of the tube 10 in order to pass into the tube 10 and open into a cavity 35 defined between the flange 26 and the end portion of the tube 20 at one side, and the tube 10 at the other side, said cavity opening into the outlet end of the burner through an annular gap 36 between the flange 26 and the tube 10.

Inside the flange 26, piezoelectrical crystals 37 are arranged, which are connected to a suitable power source over connections not shown in detail, in order to generate high-frequency vibrations which prevent incrusting of the surface 27.

When the burner is operated the coal water dispersion is supplied through the conduit 33 while primary air for atomization is supplied under pressure e.g. 7 bar through the conduit 30 and secondary air for atomization is supplied under pressure also e.g. 7 bar through the conduit 34. Preheated tertiary air at fan pressure is supplied to the tubular casing 12 through the inlet aperture 13. The rotatably mounted unit is operated at a speed of 2,700 to 10,000 rpm.

The dispersion supplied will spread out as a film on the inside conical surface 27 of the conical flange 26, and then this film is actuated by ultrasound generated by means of the piezoelectrical crystals mounted in the flange. At the same time ultrasound is generated by the primary atomizing air supplied, which hits the Hartmann generator 32. As a consequence thereof the dispersion will be disintegrated when it is discharged from the opening of the nozzle at the edge of the flange and thus is highly atomized for the subsequent burning. The dispersion thus atomized is carried away by the combustion air (atomizing air) supplied.

I claim:

1. A method for atomizing dispersions containing particles, said method comprising the steps of:

supplying the dispersion to an inner, concave surface of a rotating, conically shaped member, said inner surface having a base portion and a smaller portion adjacent to and upstream of said base portion;

spreading said dispersion over said rotating conical surface and discharging said spread dispersion as a rotating annular film from said base portion of said rotating conical surface;

supplying air as an annular flow at said base portion of said rotating conical surface inside said dispersion film to provide a rotating air curtain;

imparting to said rotating air curtain rotating high frequency sound oscillations from a rotating cavity resonator; and exposing said dispersion film to an influence of said rotating air curtain.

2. A method as claimed in claim 1, including supplying primary atomizing air coaxially with an axis of rotation of the rotating, conically concave surface for said imparting of oscillations by the rotating cavity resonator (32) arranged coaxially therewith.

3. A method as claimed in claim 2, including deflecting the air flow directed towards the rotating cavity resonator (32) to form said air curtain at the inner side of the film dispersion discharged from the rotating, conically concave surface (27).

4. A method as claimed in claim 1, wherein said imparting of said rotating sound oscillations is imparted at a frequency higher than 1 kHz and preferably lays in the ultrasound range.

5. A method as claimed in claim 1, including imparting high frequency vibrations to the rotating conically concave surface (27) to prevent incrust formation.

* * * * *